United States Patent [19]

Lawson

[11] 4,265,987

[45] May 5, 1981

[54] LITHOGRAPHIC PRINTING PLATE AND METHOD FOR THE PREPARATION OF SAME

[75] Inventor: Terence M. Lawson, Aldgate, Australia

[73] Assignee: Coulter Systems Corporation, Bedford, Mass.

[21] Appl. No.: 940,907

[22] Filed: Sep. 11, 1978

Related U.S. Application Data

[63] Continuation of Ser. No. 656,162, Feb. 9, 1976, abandoned.

[30] Foreign Application Priority Data

Jan. 20, 1976 [AU] Australia ..... 10425/76

[51] Int. Cl.[3] ..... G03G 13/26; G03G 13/28

[52] U.S. Cl. ..... 430/49; 430/94; 430/309; 430/331; 101/465; 101/467

[58] Field of Search ..... 96/1 R, 1.5, 1.6, 1.7, 96/1.8; 101/465, 467; 430/49, 94, 309, 331

[56] References Cited

U.S. PATENT DOCUMENTS

| | | | |
|---|---|---|---|
| 2,231,045 | 2/1941 | Wood | 101/465 |
| 3,309,990 | 3/1967 | Klupfel | 96/1 R |
| 3,352,669 | 11/1967 | Murphy | 430/135 |
| 3,460,476 | 8/1969 | Swigert et al. | 96/1.5 |
| 3,578,444 | 5/1971 | Silver | 96/1 R |
| 3,908,547 | 9/1975 | Rochlitz | 101/465 |
| 3,970,455 | 7/1976 | Nadeau | 96/33 |
| 4,025,339 | 5/1977 | Kuehnle | 96/1.5 |

*Primary Examiner*—Mayer Weinblatt
*Assistant Examiner*—John L. Goodrow
*Attorney, Agent, or Firm*—Silverman, Cass & Singer, Ltd.

[57] ABSTRACT

The method of preparing a lithographic printing plate containing ink receptive printing image areas and water receptive non-printing background areas in which the plate consists of a substrate having on one side thereof in sequence an electrically conductive layer and a photoconductive layer consisting of fully crystalline inorganic photoconductive substance. The method comprises the steps of forming an electrostatic latent image on the surface of said photoconductive layer, developing the electrostatic latent image to define the ink receptive printing image areas on the surface, and applying to the surface an aqueous chromic acid solution.

36 Claims, No Drawings

LITHOGRAPHIC PRINTING PLATE AND METHOD FOR THE PREPARATION OF SAME

This is a continuation of application Ser. No. 656,162 filed Feb. 9, 1976, now abandoned.

BACKGROUND OF THE INVENTION

Lithographic printing is a well known art. In lithography a printing master or plate is employed having a printing surface on which the printing image areas are ink receptive whereas the non-printing background areas are water receptive. In the process of printing, an aqueous based so-called fountain solution is applied to the printing surface of the plate and such fountain solution adheres to the water receptive background areas only. An oil base ink is then applied to the printing surface of the plate. Such ink is repelled from the fountain solution containing background areas and adheres to the oil receptive printing image areas only. The printing plate is then brought into contact with paper onto which the image is printed by ink transfer from the printing image areas, as known in so-called direct lithography, or alternatively, as known in so-called offset lithography the printing plate is brought into contact with a rubber blanket onto which the image is offset by ink transfer from the printing image areas and in turn such rubber blanket is brought into contact with paper onto which the image is finally printed by ink transfer from the rubber blanket. The above described steps of applying the fountain solution and ink to the plate are repeated preparatory to each paper copy printing.

Lithographic printing plates can be prepared by numerous methods well known in the art, and one such method is electrostatic or electrophotographic imaging.

Typically in one electrostatic imaging process a lithographic printing plate is prepared by employing a conventional electrophotographic printing element such as for instance a selenium plate for the formation thereon of a latent electrostatic image pattern by methods well known in the art and developing such image pattern by attraction thereto of electroscopic powder which is ink receptive, followed by transferring the powder image onto a water receptive lithographic substrate or plate such as treated paper or grained aluminum and the like on which the transferred powder image subsequently is fused by solvent vapour or heat to form ink receptive printing areas on the water receptive surface of the plate. In another electrostatic imaging process a lithographic printing plate is prepared by developing with toner material comprising ink receptive electroscopic marking particles the latent electrostatic image formed on a so-called electrophotographic binder plate which as is well known in the art typically comprises a paper sheet having on one side thereof a coating consisting of a photoconductor powder such as zinc oxide contained within an insulating resinous binder material, such coating being in itself generally water repellent. The water repellent surface of the plate is then rendered water receptive or converted to become water receptive in the non-image or non-printing areas which are free of ink receptive toner deposit by the application of a so-called conversion solution which again is well known in the art.

In a typical non-electrostatic method of lithographic plate preparation a water receptive grained aluminum or zinc plate is coated with a light sensitive layer and exposed to a light pattern following which the light sensitive layer is developed or processed so that only the printing image areas of such layer remain adhering to the water receptive metal surface to form the ink receptive areas thereon. In another non-electrostatic method of lithographic plate preparation an ink receptive metal surface such as copper is coated with a water receptive metal film such as chromium and such metal surface is subsequently coated with a light sensitive layer which is then exposed to a light pattern and subsequently developed to remove selectively portions of such light sensitive layer and retain same as an etch resist layer in other portions. The surface is subsequently etched whereby in portions free of said etch resist layer the water receptive metal surface is removed in the printing image areas to expose there the underlying ink receptive metal surface, the etch resist layer being subsequently removed to expose the water receptive metal surface.

Whilst electrostatic and non-electrostatic methods of lithographic printing plate preparation have been found useful, there are certain disadvantages in the prior art processes. For instance in the electrostatic process cited wherein the lithographic plate is prepared by transfer of ink receptive powder deposit onto a water receptive substrate the disadvantage is that image resolution is limited by the relatively large particle size of the developing powder and image detail is lost during the powder image transfer step. In the other electrostatic process cited wherein a binder type electrophotographic plate is employed the disadvantage lies in the relatively short run length such as a few hundred to a few thousand copies obtainable from printing plates of this kind, as the substrate employed for the binder coating usually comprises paper. In non-electrostatic methods of lithographic printing plate preparation generally the disadvantages lie in the need for relatively lengthy preparation procedures for such plates and in the need for long exposure times combined with very strong light sources to cause in the light sensitive layer the required effect or contrast for selective processing, and in addition such metal plates are relatively expensive.

It is therefore the general object of this invention to provide a novel lithographic printing plate to overcome the above noted disadvantages.

Another object of this invention is to provide a novel method of preparing a lithographic printing plate.

A further object of this invention is to provide a simple and time saving process of preparing electrostatically a lithographic printing plate.

A still further object of this invention is to provide a novel electrostatically prepared lithographic printing plate which can be exposed at camera speeds.

Yet, still a further object of this invention is to provide a novel electrostatically prepared lithographic printing plate capable of reproducing high resolution images.

Yet another object of this invention is to provide a novel electrostatically prepared lithographic printing plate capable of long run copy production.

Still another object of this invention is to provide an inexpensive lithographic printing plate.

The foregoing objects and other advantages are accomplished in accordance with this invention in the manner as described in the following.

SUMMARY OF THE INVENTION

The base for the lithographic printing plate in accordance with this invention is formed by a photoconductive member which consists of a substrate having on one side thereof a thin electrically conductive layer which has deposited thereon a photoconductive layer consisting of fully crystalline inorganic photoconductive substance such as for instance cadmium sulfide or the like. Such photoconductive layer is characterised by being free of any binder material and by being ink receptive that is to say water repellent by nature at least relatively as far as can be defined in terms of lithographic contrast.

To prepare a lithographic printing plate in accordance with this invention, a latent electrostatic image formed on the surface of the aforesaid photoconductive layer by electrostatic charging and exposure to light pattern is developed with toner material comprising electroscopic marking particles whereby toner deposits are formed in those areas which are to constitute the ink receptive printing image on the printing plate surface.

Subsequently the surface of the photoconductive layer is rendered water receptive, except in the printing image areas protected by toner deposits, by application thereto of aqueous chromic acid solution containing chromate ions to form water receptive yet substantially water insoluble chromium containing compounds by reaction with the fully crystalline inorganic photoconductive substance, to thus define the non-printing areas of the printing plate surface. Such treatment completes the printing plate preparations, following which if so desired the plate surface can be rinsed with water to remove unreacted excess solution, and dried.

The thus prepared lithographic printing plate can be employed in any conventional lithographic printing equipment using conventional fountain solutions and lithographic inks.

It will be seen that in essence the thus prepared lithographic printing plate contains water receptive non-printing background areas constituted by water receptive yet substantially water insoluble chromium compounds formed by reaction with the fully crystalline inorganic photoconductive substance contained in the photoconductive layer and ink receptive printing image areas constituted by toner deposits or, in case after treatment with acidic solution such toner deposits are removed from the surface, by the fully crystalline inorganic photoconductive substance itself which during the treatment with acidic solution remained intact between the toner deposits by virtue of protective coverage or sealing effect provided by same.

DETAILED DESCRIPTION OF THE INVENTION

The photoconductive member which forms the base for the printing plate of this invention comprises a flexible substrate such as for instance a synthetic resin polymer film carrying an inorganic conductive layer and an inorganic photoconductive layer over said conductive layer. A typical structure has the substrate formed of transparent polyester sheeting about 0.005 inch thick, for example polyethylene glycol terephthalate. The sheeting is sputtered on one surface with a conductive layer of indium-tin oxide to a thickness of about 300 Angstroms, the proportions of indium oxide to tin oxide being about nine to one, respectively. This conductive layer is an aid to charging only, is transparent to a relatively high degree to visible light and does not impair the flexibility of the substrate. The layer of photoconductive substance is applied over said conductive layer by r.f. sputtering in which the targets used are of the chemical substance being sputtered, thus avoiding reactive type sputtering. The anode which is used in a preferred process is a rotating drum over which the conductive layer bearing substrate is transported continuously. The anode is not maintained at ground potential so that there is in effect a negative bias voltage between the anode and ground giving rise to a second dark space or Langmuir sheath at the anode through which the sputtering of the photoconductive material must take place. The photoconductive layer thus formed is a deposit about 3500 Angstroms thick of uniformly-sized and closely packed highly oriented crystals of an inorganic photoconductor, the preferred photoconductive substance being cadmium sulfide (CdS). Other photoconductive materials which have been deposited successfully by the same method to form the base for the printing plate of this invention are zinc sulfide (ZnS), arsenic trisulfide ($As_2S_3$) and mixtures of these materials.

Process steps necessary for the production of the lithographic printing plate of the present invention will now be described.

The process steps consist of first electrostatically charging the photoconductive layer as is well known in the art, followed by exposure to a light pattern corresponding to the information to be printed to form an electrostatic latent image thereon which is then developed or toned by the application thereto of electroscopic marking particles to define the printing areas of the printing plate surface by the formation thereon of image deposits of such electroscopic marking or toner particles. Toners of the dry powder type or of the liquid type as is well known in the art can be employed. Liquid toners comprise electroscopic marking particles supended in an insulating carrier liquid or dispersant, such dispersant generally being defined as a liquid having a volume resistivity of greater than $10^9$ ohm-cm and dielectric constant less than 3. The toned photoconductive layer may be rinsed in clear dispersant after toning if desired, and may also be pre-rinsed before toning to prevent adsorption of toner particles to the background or non-printing areas. The toned image deposit on the photoconductive layer may be fused thereon if so desired.

The principal function of the deposits formed by electroscopic marking or toner particles in the printing image areas is to protect the underlying photoconductive layer from being affected during the subsequent step of conversion or etch treatment of the non-printing areas free of such toner particle deposits. To this end it is necessary to form toner particle deposits which are continuous that is to say free of voids through which the conversion or etch solution could penetrate to contact the under-lying photoconductive layer. For this purpose toners of the self-fixing type or of the heat or pressure fusible type can be employed.

An additional function of the deposits formed by electroscopic marking toner particles is to constitute the actual ink receptive printing areas of the printing plate surface after the step of conversion or etching of the non-printing areas of the photoconductive layer, particularly in those instances where the toner deposit adheres very strongly to the underlying photoconductive layer, as is the case when for instance heat fusible toner particles are employed. It is also possible to use less strongly adhering toner particles which after having served as a protective cover over the photoconductive layer during the step of etching or conversion are removed therefrom before or during the process of printing in which instance the protected and unaffected underlying photoconductive layer itself becomes or forms the ink receptive printing areas of the printing plate surface.

After the definition of the printing areas on the photoconductive layer by the developed toner particle deposits thereon, to complete the preparation of the lithographic printing plate surface the background areas that is to say the non-printing areas free of toner particle deposits must be converted to become water receptive, as the photoconductive layer consisting of fully crystalline inorganic photoconductive substances as employed in accordance with this invention is ink receptive that is to say water repellent by nature at least relatively as far as can be defined in terms of lithographic contrast.

The step of conversion in accordance with this invention is carried out by contacting the surface of the photoconductive layer with an aqueous chromic acid solution containing chromate ions in sufficient concentration so as to form one or more chromium containing compounds by reaction with at least the portion of the fully crystalline inorganic photoconductive substance located at the free surface of the photoconductive layer or with an additional portion thereof extending into said layer, which chromium containing compounds are characterised by being water receptive yet substantially water insoluble in order that such compounds are retained on said surface at least for the duration of the subsequent lithographic printing run and maintain the non-printing areas of the printing plate surface water receptive during same.

Water receptive yet substantially water insoluble chromium containing compounds can be formed with for instance cadmium, in the case where the fully crystalline inorganic photoconductive substance comprises cadmium sulfide, by the application thereto of chromic acid in aqueous solution to cause liberation of cadmium ions from said photoconductive substance, where such liberated cadmium ions in turn combine with chromate ions existing in the aqueous chromic acid solution to form substantially water insoluble cadmium chromates. For this reaction it is necessary to employ the chromic acid in such concentration that the chromate ions provided by same are present in a quantity exceeding the concentration required for the formation of chromates with the available cadmium.

The chromic acid in aqueous solution to be applied to the photoconductive layer can be prepared by for instance dissolving chromium trioxide in water or by dissolving in water a chromate capable of liberating chromate ions in an acidic solution such as for instance sodium bichromate and the like, where the acidity of the aqueous solution can be provided by the addition thereto of an acid such as for instance sulphuric acid and the like in such quantity that the hydrogen ion concentration in the solution is in excess of the concentration required for the liberation of cadmium ions.

Whilst in the above described method of rendering the fully crystalline inorganic photoconductive substance water receptive in the unprotected areas of the photoconductive layer free of toner deposits in accordance with this invention some portion of the chromium containing compounds formed during the reaction may be present as free precipitate in the bulk of the chromic acid solution, it has been found that surprisingly a substantial portion of the chromium containing compounds upon formation are retained at the surface of the photoconductive layer that is to say in the non-printing areas of the printing plate surface and, depending, on the extent of reaction, such chromium containing compounds may also extend into such photoconductive layer. Furthermore it was found that such retained chromium containing compounds are characterized by a surprisingly strong degree of adhesion which enables the employment of the printing plate in accordance with this invention for extended lithographic printing run lengths, such as in excess of 100,000 copies, as the water receptivity of the non-printing areas of such printing plate surface is maintained during such run lengths by the continued adherence thereto of the water receptive chromium containing compounds.

Whilst not wishing to be bound by any theory, it is believed that the surprisingly strong adhesion exhibited by the aforementioned chromium containing compounds is attained substantially in view of the physical nature of the fully crystalline inorganic photoconductive substance such as for instance cadmium sulfide comprising the photoconductive layer and the method of forming or depositing such photoconductive substance in closely packed and highly oriented crystalline form as has been described in the foregoing, which allows substitution within the crystal lattice to occur in a particularly regular and uniform manner.

The above disclosed process of conversion in accordance with this invention that is of treating the photoconductive layer with the aqueous chromic acid solution can be carried out conveniently by immersion followed by rinsing in clear water to remove unreacted chromic acid and non-adhering chromium containing compounds as well as other by-products which may have formed during the reaction depending on the type of chromate and acid employed in preparing the aqueous chromic acid solution. The reaction time necessary for the production of a functionally adequate water receptive surface depends on the concentration of chromate ions and hydrogen ions in the aqueous chromic acid solution as has been disclosed in the foregoing, as well as on the temperature of such solution. It has been found that for convenience of operation it is advantageous to maintain the aqueous chromic acid solution at around room temperature or in the range from about 60 degrees F. to about 80 degrees F. and to adjust the chromate ion and hydrogen ion concentration therein for a reaction time in the range from a few seconds to a few minutes, preferably about 30 seconds.

The lithographic printing plate prepared in accordance with the process of this invention as disclosed in the foregoing can be positioned on the plate cylinder of a lithographic printing press and employed without any further treatment as a conventional printing plate to print the desired number of copies. Conventional fountain solutions and lithographic inks can be used and furthermore conventional chemicals or preparations such as for instance gum arabic or gum acacia solution, ferrocyanide containing preparations, electrostatic etches or conversion solutions, asphaltum washout and the like materials as generally employed in the art of lithography for plate conditioning, preservation, antiscumming and the like reasons can also be used advantageously with the lithographic printing plate of this invention.

It should be realized that the plate preparation process of this invention as described in the foregoing may be carried out in a relatively short time as each of the exposing, toning, toner deposit fusing and conversion steps requires times of the order of seconds only. In addition the photoconductive layer consisting of fully crystalline inorganic substance deposited by the sputtering process as hereinbefore described is characterized by a high degree of light sensitivity, and this allows the printing plate to be exposed in a camera if so desired. Thus when the lithographic printing plate of this invention is employed, the printing run can commence within a few minutes of the start of plate preparation.

The following Examples will further illustrate the principles of this invention.

EXAMPLE 1

The photoconductive member was prepared as described in the foregoing using the polyester substrate, indium-tin oxide conductive layer of about 300 Angstroms and a photoconductive layer consisting of cadmium sulfide of about 3000 Angstroms thickness.

An electrostatic latent image was produced on the surface of the photoconductive layer by applying a uniform negative electrostatic charge to the surface by means of a corona discharge device and then exposing at 50 ft. candle seconds to radiation comprising a light pattern representing the subject matter to be reproduced.

The electrostatic latent image was developed by immersion in a liquid dispersion of electroscopic marking particles to tone the image areas by attraction thereto of such electroscopic marking particles.

The dispersion was prepared as follows:

Polystyrene resin: 100 grms.

was melted and

Pigment Red CI 53: 20 grms.

was added. The mixture was stirred in a heated blender until homogenized. The mixture was cooled and then crushed to form pigmented resin particles within the range 20–200μ. The following mixture was then prepared:

Pigmented resin: 20 grms.

Alkyd resin: 40 grms.

Isoparaffinic hydrocarbon: 140 grms.

The mixture was ball milled for 48 hours. This formed the toner concentrate. The liquid dispersion was prepared by dispersing the above concentrate in isoparaffinic hydrocarbon dispersant in the proportion 5–20 grms. of concentrate per 1 liter of dispersant. The toner or electroscopic marking particles in dispersed form were within the size range 1–5μ.

The polystyrene resin had a melting point of 150° C., molecular weight about 5000, acid value below 1.

The alkyd resin was a safflower oil extended glycerol based long oil alkyd, oil length 64%, solids content 69–71% in aliphatic hydrocarbon solvent, acid value 6–10.

After toning the surface of the photoconductive layer was rinsed in clear isoparaffinic hydrocarbon dispersant, dried and heated to a temperature of about 150°–160° C. to fuse the toner deposits.

An aqueous chromic acid solution was prepared as follows:

Sulfuric acid (concentrated): 114 grms.

Water: 40 grms.

Potassium bichromate: 5 grms.

were mixed and then diluted with an equal volume of water.

The imaged photoconductive member was immersed for 30 seconds in the above aqueous chromic acid solution held at the temperature of about 70 degrees F. and then rinsed in water.

The above treatment rendered water receptive the surface of the photoconductive layer free of toner deposits to form the non-printing areas of the printing plate surface whereas the printing areas thereon were formed by the fused ink receptive toner deposits.

The thus prepared lithographic printing plate was placed on the plate cylinder of an off-set duplicator. Using black jobbing off-set ink and standard fountain solution several thousand copies of excellent quality and high resolution were produced.

EXAMPLE 2

The potassium bichromate of Example 1 was replaced by an equal weight of ammonium bichromate.

EXAMPLES 3 and 4

The 114 grms. of concentrated sulfuric acid of Examples 1 and 2 was replaced by 70 grms. of 40% aqueous solution of hydrofluoric acid. The immersion time of 30 seconds of Examples 1 and 2 was increased to 50 seconds.

EXAMPLE 5

Example 1 was repeated with the exception that the aqueous chromic acid solution comprised the following mixture:

Sulfuric acid (concentrated): 36 grms.

Water: 1100 grms.

Sodium bichromate: 36 grms.

The solution was held at 70 degrees F. and the immersion time was 1.5 minutes.

EXAMPLE 6

The mixture of Example 5 was diluted with an equal volume of water to form the aqueous chromic acid solution. The solution was held at 70 degrees F. and immersion time was 3 minutes.

EXAMPLE 7

Example 1 was repeated with the exception that the aqueous chromic acid solution comprised the following:

Chromic acid anhydride: 60 grms.

Water: 100 grms.

In this solution the chromate ions and the hydrogen ions were both provided by chromic acid formed by dissolving the chromic acid anhydride in water.

The solution was held at 75 degrees F. and the immersion time was 1.75 minutes.

EXAMPLE 8

In Example 7 the temperature of the aqueous chromic acid solution was raised to 90 degrees F. and the immersion time was reduced to 20 seconds.

EXAMPLE 9

In Example 7 the temperature of the aqueous chromic acid solution was raised to 105 degrees F. and the immersion time was reduced to 6 seconds.

EXAMPLE 10

In Example 8 the aqueous chromic acid solution was diluted with an equal volume of water. The immersion time was increased to 50 seconds.

EXAMPLES 11–17

In Examples 1 to 7 the liquid dispersion of electroscopic marking particles was prepared as follows:

Pigment Blue CI 15: 100 grms.

Alkyd resin: 400 grms.

Isoparaffinic hydrocarbon: 300 grms.

were bailed milled for 48 hours to form the toner concentrate. The liquid dispersion was prepared by dispersing the above concentrate in isoparaffinic hydrocarbon dispersant in the proportion 15–25 grms. of concentrate per 1 liter of dispersant. The electroscopic marking particles in the dispersed form were within the size range 0.5–2$\mu$.

The alkyd resin was a safflower oil modified urethane alkyd, oil length 67%, solids content 60% in aliphatic hydrocarbon solvent, acid value below 2.

After toning the surface of the photoconductive layer was rinsed in clear isoparaffinic hydrocarbon dispersant and air dried.

The toned photoconductive member was immersed in the aqueous chromic acid solution and then rinsed in water.

The thus prepared lithographic printing plate was placed on the plate cylinder of an off-set duplicator. The toner deposits were ink receptive and formed the printing image areas.

EXAMPLES 18–24

In Examples 11 to 17 after immersing the toned photoconductive member in the aqueous chromic acid solution and rinsing in water the member was air dried following which the toner image deposits formed by the electroscopic marking particles were removed from the photoconductive layer by wiping with a pad soaked in isoparaffinic hydrocarbon whereby the underlying portions of the surface of the photoconductive layer became exposed. The surface was air dried.

The thus prepared lithographic printing plate was placed on the plate cylinder of an off-set duplicator. The exposed surface of the photoconductive layer was ink receptive and formed the printing image areas.

There has been described a novel lithographic printing plate and the method for the preparation of same, and there has been disclosed a range of materials which can be used in accordance with this invention. It should be understood that the Examples given are to be construed as illustrative only and not in a restrictive sense as other changes and substitutions may be made as will be obvious to those skilled in the art without departing from the spirit of this invention.

I claim:

1. The method of preparing a lithographic printing plate containing ink receptive printing image areas and water receptive non-printing background areas wherein said plate consists of a substrate having on one side thereof in sequence an electrically conductive layer and a layer of photoconductive material selected from the group consisting of primarily cadmium sulfide, zinc sulfide and a mixture of zinc sulfide and cadmium sulfide, the photoconductive layer being fully crystalline, with the crystals all closely packed highly oriented, said photoconductive layer being deposited by r.f. sputtering under a negative bias and having a light transmissivity of at least 70 percent, which material is reactive with chromic ion in an aqueous acid solution to form hydrophilic chromates, which method comprises the steps of forming an electrostatic latent image on the surface of said photoconductive layer by firstly applying uniform electrostatic charges thereto and then exposing to a radiation pattern, developing said electrostatic latent image by attraction thereto of electroscopic marking particles to define said ink receptive printing image areas on said surface, and applying to said surface an aqueous chromic acid solution containing chromate ions and hydrogen ions in such concentration so that the chromate ions exceed the concentration required for the formation of chromates with the available metallic ion of the phtotoconductive layer to assure full conversion of said exposed material to the hydrophilic metal chromate whereby there is formed at least one water receptive yet substantially water insoluble chromium containing compound by reaction with at least part of said fully crystalline inorganic photoconductive substance contained in said photoconductive layer in areas free of said electroscopic marking particles to thereby form said water receptive non-printing background areas on said surface without conversion of that portion of said photoconductive surface below said electroscopic marking particles to the hydrophilic chromate.

2. The method as claimed in claim 1 in which after the step of applying an aqueous chromic acid solution to the surface of the photoconductive layer such surface is rinsed with water.

3. The method as claimed in claim 2 in which the printing plate consists of a polyester substrate having on one side thereof in sequence an electrically conductive indium-tin oxide layer and the photoconductive material is primarily cadmium sulfide deposited by sputtering.

4. The method as claimed in claim 3 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

5. The method as claimed in claim 2 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

6. The method as claimed in claim 1 in which the printing plate consists of a polyester substrate having on one side thereof in sequence an electrically conductive indium-tin oxide layer and the photoconductive material is primarily cadmium sulfide.

7. The method as claimed in claim 6 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

8. The method as claimed in claim 1 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

9. The method as claimed in claim 1 and the step of fusing said electroscopic marking particles to said surface to thereby form said ink receptive printing image areas on said surface prior to formation of said water receptive background areas.

10. The method as claimed in claim 9 in which after the step of applying an aqueous chromic acid solution to the surface of the photoconductive layer such surface is rinsed with water.

11. The method as claimed in claim 10 in which the printing plate consists of a polyester substrate having on one side thereof in sequence an electrically conductive indium-tin oxide layer and the photoconductive material is primarily cadmium sulfide.

12. The method as claimed in claim 11 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

13. The method as claimed in claim 10 in which in the aqueous chromic acid solution the chromate ions are provided by chromium compounds selected from the group consisting potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

14. The method as claimed in claim 9 in which the printing plate consists of a polyester substrate having on one side thereof in sequence an electrically conductive indium-tin oxide layer and the photoconductive material is primarily cadmium sulfide.

15. The method as claimed in claim 14 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

16. The method as claimed in claim 9 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

17. The method as claimed in claim 9 in which the fused electroscopic marking particles are removed from said surface subsequent to formation of said water receptive background areas whereby to expose the underlying photoconductive layer, said ink receptive printing image areas on said surface constituting the exposed photoconductive layers.

18. The method as claimed in claim 17 in which after the step of applying an aqueous chromic acid solution to the surface of the photoconductive layer such surface is rinsed with water.

19. The method as claimed in claim 18 in which the printing plate consists of a polyester substrate having on one side thereof in sequence an electrically conductive indium-tin oxide layer and the photoconductive material is primarily cadmium sulfide.

20. The method as claimed in claim 19 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

21. The method as claimed in claim 18 in which in the aqueous chromic acid solution and chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

22. The method as claimed in claim 17 in which the printing plate consists of a polyester substrate having on one side thereof in sequence an electrically conductive indium-tin oxide layer and the photoconductive material is primarily cadmium sulfide.

23. The method as claimed in claim 22 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

24. The method as claimed in claim 17 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid by dissolving chromic acid anhydride in water.

25. The method as claimed in claim 1 in which said electroscopic marking particles are removed after formation of said water receptive background areas.

26. The method as claimed in claim 25 in which after the step of applying an aqueous chromic acid solution to the surface of the photoconductive layer such surface is rinsed with water.

27. The method as claimed in claim 26 in which the printing plate consists of a polyester substrate having on one side thereof in sequence electrically conductive indium-tin oxide layer and the photoconductive material is primarily cadmium sulfide.

28. The method as claimed in claim 27 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

29. The method as claimed in claim 26 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

30. The method as claimed in claim 25 in which the printing plate consists of a polyester substrate having on one side thereof in sequence an electrically conductive indium-tin oxide layer and the photoconductive material is primarily cadmium sulfide.

31. The method as claimed in claim 30 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

32. The method as claimed in claim 25 in which in the aqueous chromic acid solution the chromate ions are provided by chromium compounds selected from the group comprising potassium bichromate, sodium bichromate, ammonium bichromate and chromic acid anhydride and the hydrogen ions are provided by acids selected from the group comprising sulfuric acid, hydrofluoric acid and chromic acid formed by dissolving chromic acid anhydride in water.

33. A lithographic printing plate containing ink receptive printing image areas and water receptive nonprinting background areas consisting of a substrate having on one side thereof in sequence an electrically conductive layer and a layer of photoconductive material selected from the group consisting of primarily cadmium sulfide, zinc sulfide and mixtures of zinc sulfide and cadmium sulfide, said photoconductive layer being fully crystalline with all crystals thereof closely packed highly oriented and deposited by r.f. sputtering with a negative bias and having a light transmissivity of at least 70 percent, which material is reactive with chromic ion in aqueous acid solution to form hydrophilic chromates, characterized by said ink receptive printing image areas being constituted by electroscopic marking particles deposited onto the surface of said photoconductive layer and further characterized by said water receptive background areas constituted by at least one water receptive yet substantially water insoluble chromium compound formed by reaction of the chromic ion in an acidic medium with the metal ion of said fully crystalline inorganic photoconductive material contained in said photoconductive layer with the surface below said electroscopic marking particles being essentially unchanged.

34. A lithographic printing plate as claimed in claim 33 in which such plate consists of a polyester substrate having on one side thereof in sequence an electrically conductive indium-tin oxide layer and the photoconductive material is primarily cadmium sulfide.

35. A lithographic printing plate containing ink receptive printing image areas and water receptive nonprinting background areas consisting of a substrate having on one side thereof in sequence an electrically conductive layer and a layer of photoconductive material selected from the group consisting of primarily cadmium sulfide, zinc sulfide and mixtures of ZnS and CdS, said photoconductive layer being closely packed highly oriented and deposited by r.f. sputtering with a negative bias and having a light transmissivity of at least 70 percent, which material is reactive with chromic ion in aqueous acid solution to form hydrophilic chromates, characterized by said ink receptive printing image areas being constituted by the surface of said photoconductive layer and further characterized by said water receptive background areas being constituted by at least one water receptive yet substantially water insoluble chromium compound formed by reaction of the chromic ion in an acidic medium with the metal ion of said fully crystalline inorganic photoconductive material contained in said photoconductive layer with the surface below said electroscopic marking particles being essentially unchanged.

36. A lithographic printing plate as claimed in claim 35 in which such plate consists of a polyester substrate having on one side thereof in sequence an electrically conductive indium-tin oxide layer and a photoconductive layer consisting of fully crystalline and oriented cadmium sulfide deposited by sputtering.

* * * * *